United States Patent [19]

Sowards

[11] Patent Number: 4,744,734

[45] Date of Patent: May 17, 1988

[54] MEANS FOR CONTROLLING AIR DISCHARGE, IN AN AIR COMPRESSOR

[75] Inventor: Brian D. Sowards, Mocksville, N.C.

[73] Assignee: Ingersoll-Rand Company, Woodcliff Lake, N.J.

[21] Appl. No.: 75,386

[22] Filed: Jul. 20, 1987

[51] Int. Cl.[4] ..... F04B 49/00; F04B 31/44

[52] U.S. Cl. ..... 417/440; 251/228

[58] Field of Search ..... 251/228; 417/440, 305

[56] References Cited

U.S. PATENT DOCUMENTS

| | | | |
|---|---|---|---|
| 830,046 | 9/1906 | Bole | 417/305 |
| 2,164,451 | 7/1939 | Fast | 123/559 |
| 2,294,743 | 9/1942 | Funderburk | 123/559 |
| 2,311,936 | 2/1943 | Elfes et al. | 417/310 |
| 2,524,474 | 10/1950 | Randel | 251/228 |
| 2,988,070 | 6/1961 | Brueder | 123/564 |
| 3,747,617 | 7/1973 | Katchka | 251/228 |
| 4,207,743 | 1/1980 | Ecomard et al. | 60/611 |
| 4,364,366 | 12/1982 | Terwilliger | 123/564 |
| 4,364,367 | 12/1982 | Terwilliger | 123/564 |
| 4,373,337 | 2/1983 | Widman | 60/611 |
| 4,392,472 | 7/1983 | Merritt et al. | 123/564 |
| 4,393,852 | 7/1983 | Merritt et al. | 123/564 |
| 4,498,849 | 2/1985 | Schibbye | 417/440 |

FOREIGN PATENT DOCUMENTS

| | | | |
|---|---|---|---|
| 538734 | 11/1931 | Fed. Rep. of Germany | 251/228 |
| 2136740 | 2/1973 | Fed. Rep. of Germany | 251/228 |
| 1303685 | 8/1962 | France | 417/440 |
| 59-101536(A) | 6/1984 | Japan | 123/564 |
| 16268 | of 1901 | United Kingdom | 417/302 |

*Primary Examiner*—William L. Freeh

*Attorney, Agent, or Firm*—B. J. Murphy

[57] ABSTRACT

An air compressor having a pair of coacting rotors, useful as a supercharger for an engine, has a throttle plate in the compressed-air discharge port of its airend. The plate is carried by a shaft which is journalled in the airend housing. An air bypass channel is formed in the housing, The channel being in communication with the air-end air inlet. A pair of apertures formed in the housing open onto both the channel and the rotors, and flapper valves, pivotably mounted in the channel, monitor the apertures. Spring steel limbs, fixed to the throttle plate shaft engage and disengage the valves, to close and open the apertures, respectively, as the shaft is rotated to open and close the compressed-air discharge port, respectively again, by means of the throttle plate.

8 Claims, 4 Drawing Sheets

MEANS FOR CONTROLLING AIR DISCHARGE, IN AN AIR COMPRESSOR

This invention pertains to air compressors' unloaders, generally and in particular to a novel means for controlling air discharge through the discharge port of an air compressor.

In the prior art are various types of unloaders for air compressors, or for the airends thereof, that is, which are rather complex and, consequently, are expensive to produce and repair. Too, the known types typically cause the airend to operate with vacuum pressure, and this occasions disadvantages which are better avoided. Commonly, the prior art unloaders are fully loaded or unloaded as the operating components thereof effect a "snap action" response.

It is an object of this invention to set forth an inventive means for controlling air discharge through the discharge port of an air compressor which is uncomplicated, efficient, avoids the production of vacuum pressure, and provides for smooth-acting responses.

Particularly, it is an object of this invention to set forth, in an air compressor having a housing, and coacting rotors therewithin, said housing having a discharge port opening onto said rotors, means for controlling air discharge through said port, comprising throttle means in said port, and movable therewithin between a first disposition thereof in which said throttle means occludes said port, and a second disposition thereof in which said throttle means opens said port; an air bypass channel formed in said housing and opening onto said rotors; closure means in said channel, and movable therewithin between a given disposition thereof in which said closure means closes off said channel from fluid communication with said rotors, and in another disposition thereof in which said closure means opens said channel to fluid communication with said rotors; and means engaging both said throttle means and said closure means for causing said closure means to move between said given and another dispositions in response to movement of said throttle means between said first and second dispositions.

Further objects of this invention, as well as the novel features thereof, will become more apparent by reference to the following description, taken in conjunction with the accompanying figures, in which.

Figure 1:
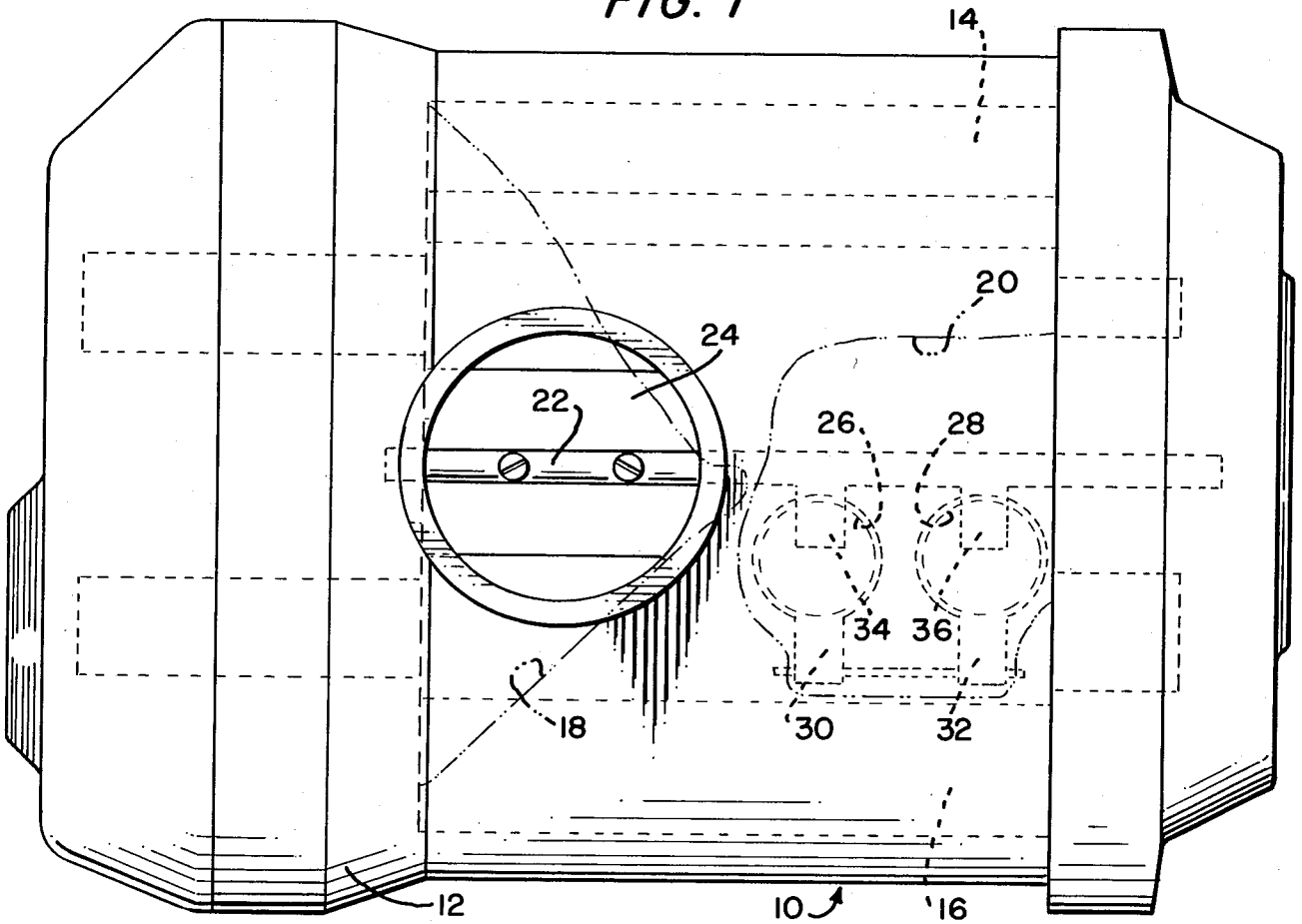
FIG. 1 is a cross-sectional view, taken along the longitudinal center of the airend of an air compressor, the same showing an embodiment of the invention.

As shown in FIGS. 1 through 3, and 5, an air compressor airend 10 has a housing 12 in which are coacting rotors 14 and 16. Shown only in phantom, in FIG. 1, are the compressed-air discharge port 18 and a bypass channel 20. A shaft 22 is journalled in the housing 12 and has secured thereto a throttle plate 24. A pair of apertures

26 and 28 open onto both the channel 20 and the rotors 14 and 16. Patently, with the apertures 26 and 28 occluded, the airend 10 is capable of compressing air and delivering the same through port 18. Channel 20 communicates with the air-inlet (not shown) of the airend 10 by conventional means (not shown) and, consequently, if apertures 26 and 28 are open—exposed to channel 20 and rotors 14 and 16—the airend 10 will be unloaded.

A pair of flapper valves 30 and 32 are pivotably pinned in the channel 26 and 28. Throttle-plate shaft 22 also has a pair of spring-steel limbs 34 and 36 fixed thereto in parallel. Each limb is somewhat bent back upon itself, at the projecting end thereof, to define a smooth "knee" thereof for engaging a given one of the flapper valves 30 and 32.

Figure 2:
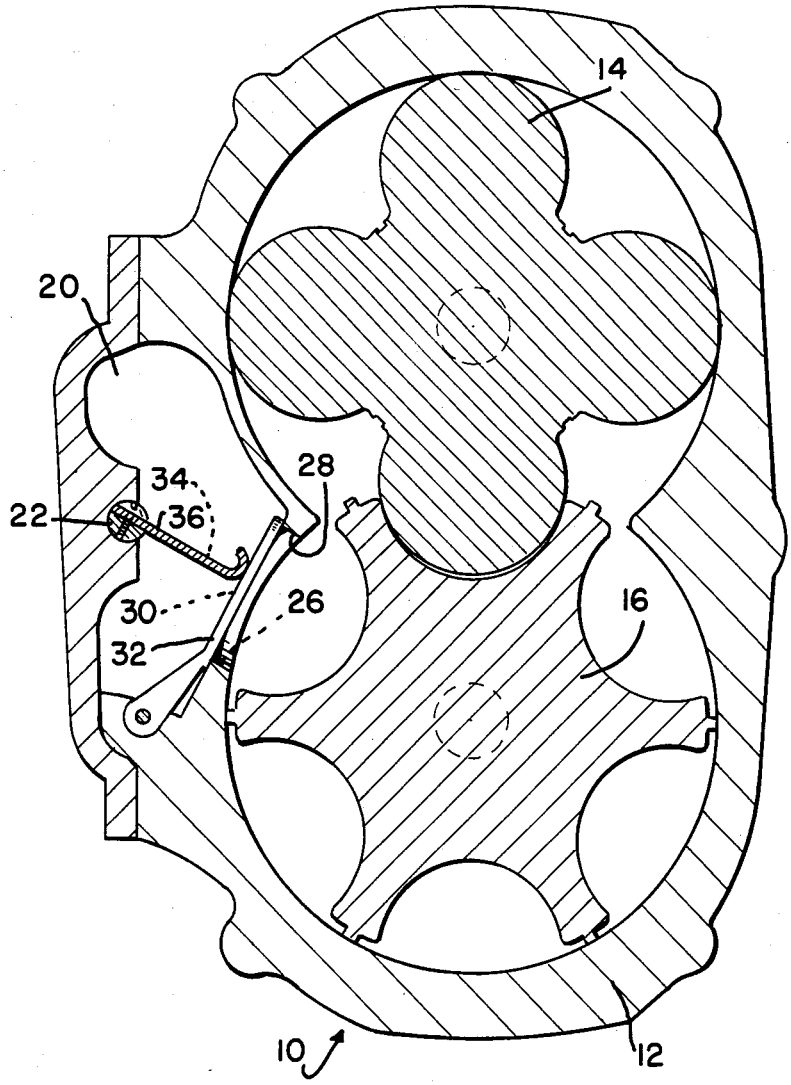
FIG. 2 is a cross-sectional view, taken in a plane normal to the rotor axes, depicting the bypass channel, flapper valve(s) and aperture(s) of the FIG. 1 embodiment.
Figure 3:
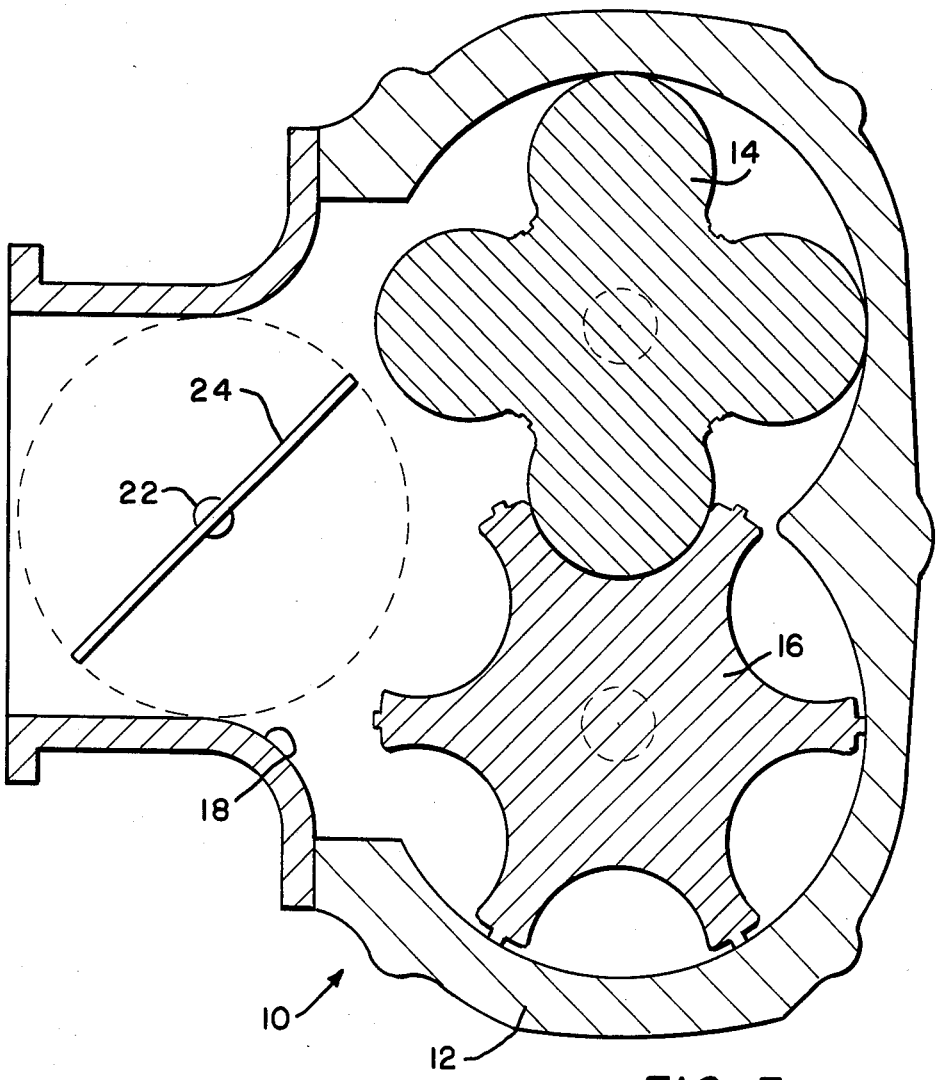
FIG. 3 is a cross-sectional view, similar to that of FIG. 2, depicting, instead, the throttle plate and compressed-air discharge port arrangement.

As perhaps can best be seen in FIGS. 1 and 2, the plate 24 is shown in its open, or unthrottling, disposition, and the flapper valves 30 and 32 are shown closed; this so, because limbs 34 and 36 are bearing against the valves 30 and 32 when the plate 24 is open. Too, when the plate 24 is in its closed disposition, in occlusion of the discharge port 18, the limbs 34 and 36 are withdrawn, i.e., rotated away from the valves 30 and 32. The latter, then, open (due to the force of air from the rotors 14 and 16) to shunt the rotors' air product through the channel 20 and back to the inlet (not shown).

By rotating the shaft 22, by any suitable means, at a desired rate, the airend 10 can be changed, gradually or rapidly, between loaded and unloaded states of operation.

Figure 4:
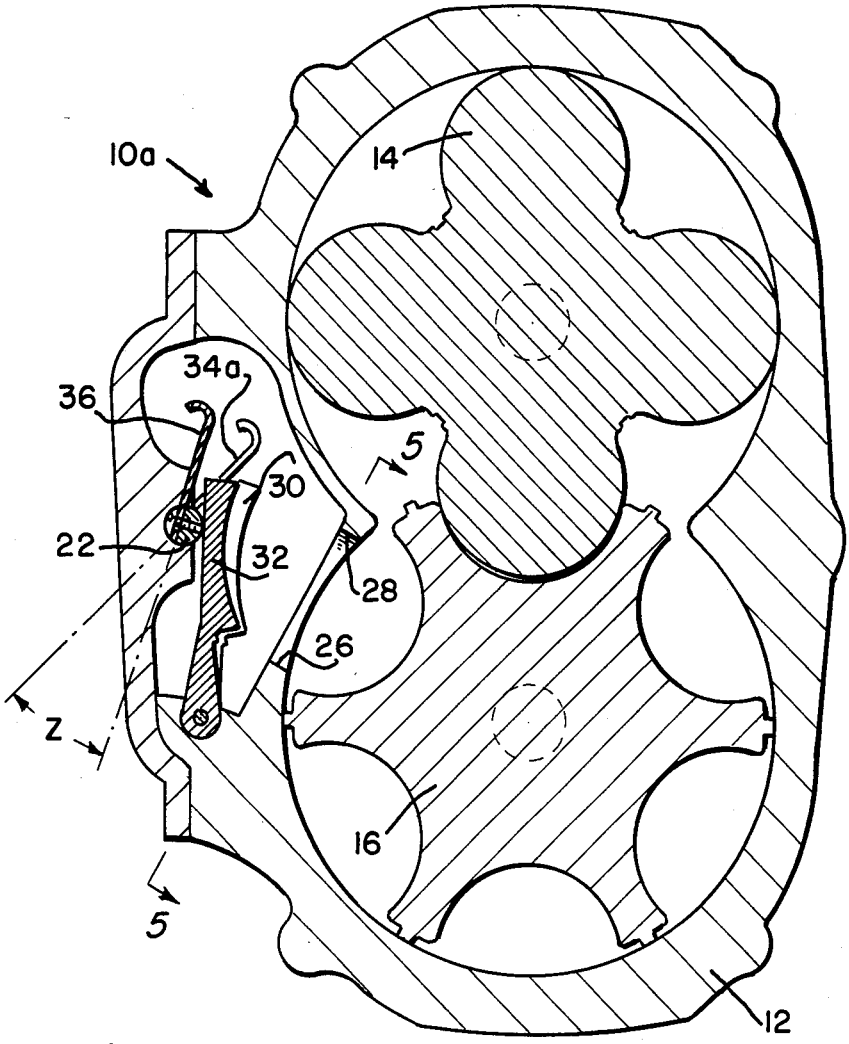
FIG. 4 is an illustration, very similar to that of FIG. 2, of an alternative embodiment of the invention in which the flapper valves are staged.
Figure 5:
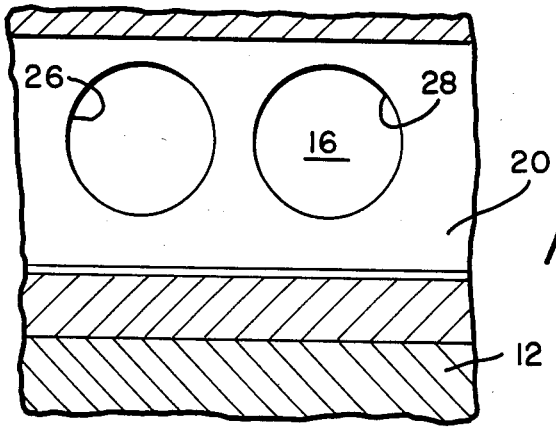
FIG. 5 is a cross-sectional view taken along section 5—5 of FIG. 4.

FIG. 4 discloses an alternative embodiment of the invention; herein, same or similar index numbers denote same or similar components as in the first embodiment.

Airend **10*a*, of the FIG. 4 alternative embodiment, is differing in one respect. Spring steel limbs 34*a* and 36 are set on the shaft 22 out of axial parallelism. That is, the limbs 34*a* and 36, relative to the axis of shaft 22, are radially divergent to define an acute angle "Z" therebetween. As a result of this, limb 34*a* causes flapper valve 30 to close off aperture 26 earlier than limb 32 closes off aperture 28. In this way, the loading of the airend 10*a* can be staged. Conversely, on unloading of airend 10*a*, limb 34*a* will hold aperture 26 closed longer than will limb 36 hold aperture 28** closed; the unloading, too, then, is staged.

The invention comprises a built-in safety feature. It may be assumed, as such is conventional, that the shaft 22 is remotely, cable-controlled. Now, should such control cable break, my invention will effect an automatic throttling. The valves 30 and 32 are always addressed by the force of air—whether in closed or open positioning—but especially when the airend 10 (or **10*a*) is running loaded. If the throttle control cable fails, the air pressure will slue the valves 30 and 32 to their open positioning and, in turn, this will cause the limbs 34 (and 34*a*) and 36 to rotate and turn the shaft 22 therewith. The rotation of the shaft will dispose the plate 24 in its throttling position in port 18 and, of course, opened apertures 26 and 28** will shunt the air to the airend inlet.

While I have described my invention in connection with specific embodiments thereof, it is to be clearly understood that this is done only by way of example and not as a limitation to the scope of my invention as set forth in the objects thereof and in the appended claims.

I claim:

1. In an air compressor having a housing, and coacting rotors therewithin, said housing having a discharge port opening onto said rotors, means for controlling air discharge through said port, comprising:

throttle means in said port, and movable therewithin between a first disposition thereof in which said throttle means occludes said port, and a second disposition thereof in which said throttle means opens said port;

an air bypass channel formed in said housing and opening directly onto said rotors;

closure means in one end of said channel, and movable therewithin between a given disposition thereof in which said closure means closes off said channel from fluid communication with said rotors, and in another disposition thereof in which said closure means opens said channel to fluid communication with said rotors; and means engaging both said throttle means and said closure means for causing said closure means to move between said given and another dispositions in response to movement of said throttle means between said first and second dispositions.

2. Air discharge controlling means, according to claim 1, further including:

a plurality of air-bypassing apertures, formed in said housing, which open onto said channel; and wherein said closure means comprises a like plurality of valving elements coupled to said housing (a) movable into closure of said apertures, and (b) removable from said apertures to open said apertures to said channel; and said engaging means comprises limb means, coupled to said housing, for forcing said elements into closure of said apertures.

3. Air discharge controlling means, according to claim 1, further including:

a plurality of air-bypassing apertures, formed in said housing, which open onto said channel; wherein said closure means comprises a like plurality of valving elements coupled to said housing (a) movable into closure of said apertures, and (b) removable from said apertures to open said apertures to said channel; and said engaging means comprises means for causing one of said valving elements to close off one of said apertures earlier than another of said valving elements closes off another of said apertures.

4. In an air compressor having a housing, and coacting rotors therewithin, said housing having a discharge port opening onto said rotors, means for controlling air discharge through said port, comprising:

throttle means in said port, and movable therewithin between a first disposition thereof in which said throttle means occuldes said port, and a second disposition thereof in which said throttle means opens said port;

an air bypas channel formed in said housing and opening onto said rotors;

closure means in said channel, and movable therewithin between a given disposition thereof in which said closure means closes off said channel from fluid communication with said rotors, and in another disposition thereof in which said closure means opens said channel to fluid communication with said rotors;

means engaging both said throttle means and said closure measn for causing said closure means to move between said given and another dispositions in response to movement of said throttle means between said first and second dispositions; and an air-bypassing aperture, formed in said housing, which opens onto said channel; and wherein said closure means comprises a valving element coupled to said housing (a) movable into closure of said aperture, and (b) removable from said aperture to open said aperture to said channel; and said engaging means comprises limb means, coupled to said housing, for forcing said element into closure of said aperture.

5. Air discharge controlling means, according to claim 4, further including:

a plurality of air-bypassing apertures, formed in said housing, which open onto said channel; wherein said closure means comprises a like plurality of valving elements coupled to said housing (a) movable into closure of said apertures, and (b) removable from said apertures to open said apertures to said channel; and said engaging means comprises means for causing one of said valving elements to retain one of said apertures in a closed-off condition longer than another of said valving elements retains another of said apertures in a closed-off condition.

6. Air discharge controlling means, according to claim 4, wherein:

said throttle means comprises a throttle palte;

said limb means comprises a shaft journalled in said housing;

said plate is fixed to said shaft; and said limb means further comprises a limb coupled to said shaft and projecting therefrom for (a) sluing through an arc and, consequently, (b) engaging said valving element to force said element into closure of said aperture, and disengaging said element to permit removal of said element from closure of said aperture.

7. Air discharge controlling means, according to claim 6, wherein:

said valving element comprises a flapper valve; and said limb is formed of spring steel, and has a projecting end which is partially bent back upon itself.

8. In an air compressor having a housing, and coacting rotors therewithin, said housing having a discharge port opening onto said rotors, means for controlling air discharge through said port, comprising:

throttle means in said port, and movable therewithin between a first disposition thereof in which said throttle means occludes said port, and a second disposition thereof in which said throttle means opens said port;

an air bypass channel formed in said housing and opening onto said rotors;

closure means in said channel, and movable therewithin between a given disposition thereof in which said closure means closes off said channel from fluid communication with said rotors, and in another disposition thereof in which said closure means opens said channel to fluid communication with said rotors;

means engaging both said throttle means and said closure means for causing said closure means to move between said given and another dispositions in response to movement of said throttle means between said first and second dispositions; and a plurality of air-bypassing apertures, formed in said housing, which open onto said channel; and wherein said closure means comprises a like plurality of valving elements coupled to said housing (a) movable into closure of said apertures, and (b) removable from said apertures to open said apertures to said channel;

said engaging means comprises limb means, coupled to said housing, for forcing said elements into closure of said apertures;

said throttle means comprises a throttle plate;

said limb means comprises a shaft journalled in said housing;

said plate is fixed to said shaft; and said limb means further comprises a same plurality of limbs coupled to said shaft and projecting therefrom for (a) sluing through a common arc and, consequently, (b) engaging said valving elements to force said elements into closure of said apertures, and disengaging said elements to permit removal of said elements from closure of said apertures.

* * * * *